US006373787B1

(12) United States Patent
Breimesser et al.

(10) Patent No.: US 6,373,787 B1
(45) Date of Patent: Apr. 16, 2002

(54) SYSTEM FOR GENERATING A HUMANLY PERCEPTIBLE SIGNAL AS A REMINDER FOR ADMINISTRATION OF A MEDICAL TREATMENT

(75) Inventors: Fritz Breimesser, Nuemberg; Klaus Abraham-Fuchs, Erlangen; Thomas Birkhoelzer, Weisendorf; Alexander Herold, Erlangen, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/554,350

(22) PCT Filed: Nov. 12, 1998

(86) PCT No.: PCT/DE98/03334

§ 371 Date: Jul. 17, 2000

§ 102(e) Date: Jul. 17, 2000

(87) PCT Pub. No.: WO99/23995

PCT Pub. Date: May 20, 1999

(30) Foreign Application Priority Data

Nov. 12, 1997 (DE) ..... 197 50 139

(51) Int. Cl.[7] ..... G04B 47/00
(52) U.S. Cl. ..... 368/10; 368/12
(58) Field of Search ..... 368/10, 11, 46, 368/47; 221/2, 3, 15

(56) References Cited

U.S. PATENT DOCUMENTS 4,695,954 A * 9/1987 Rose et al. ..... 364/413
4,725,997 A * 2/1988 Urquhart et al. ..... 368/10
5,583,831 A 12/1996 Churchill et al.

FOREIGN PATENT DOCUMENTS

DE OS 44 13 646 10/1995
WO WO 97/24702 7/1997

* cited by examiner

*Primary Examiner*—Vit Miska
(74) *Attorney, Agent, or Firm*—Schiff Hardin & Waite

(57) ABSTRACT

A system for generating a humanly perceptible signal at one or more predetermined points in time, at which one or more medications must be taken or a time-dependent medical procedure must be implemented, includes a control unit at which the time or times are stored, and which includes a time measuring unit which provides a signal upon the occurrence of the time or times, and at least one signaling device disposed remote from said control unit, which receives a signal via a communication system from the control unit and which emits a visually perceptible reminder upon receipt of the signal. The control unit and the signal device are disposed in a building which is occupied, or can be occupied at times, by a patient, and the communication system is integrated as a part of the building.

26 Claims, 2 Drawing Sheets

FIG. 1

SYSTEM FOR GENERATING A HUMANLY PERCEPTIBLE SIGNAL AS A REMINDER FOR ADMINISTRATION OF A MEDICAL TREATMENT

BACKGROUND OF THE INVENTION

1. Field of the Invention

The present invention is directed to a system for the need-dependent generation of a signal perceptible by a person at one or more predetermined points in time at which one or more medications must be taken or a time-related medical measure is to be implemented.

2. Description of the Prior Art

Persons who must take medications regularly often have the problem of forgetting to take the medication altogether or, of overlooking the administration time prescribed by the physician. This problem particularly occurs in with older persons or patients who must take many medications at different times. Signal devices, for example in the form of small portable devices, are known in the prior art, for example German OS 44 13 646, which include time-measuring means and generate an alarm signal in the fashion of a timer at the respectively required points in time at a body-worn device or a carried device. These devices, however, can only remind the user of the administration of medication when they are located in the immediate environment of the user at the point in time of the signaling. Many persons, however, do not always carry or wear these devices, particularly in the domestic environment; on the contrary, these devices are often placed down at locations that are so far from the location of the patient that the signal does not reach the patient. Such systems are also disclosed by PCT Application WO 97/24702 and U.S. Pat. No. 5,583,831.

SUMMARY OF THE INVENTION

An object of the present invention is to provide a system of the type initially described that makes it possible to provide the patient with the corresponding signal indicating the administration of medication at different locations, essentially within a building, for example a house or an apartment.

This object is achieved in accordance with the principles of the present invention in a system for generating a humanly perceptible signal as a reminder for administration of a medical treatment, having a control unit, disposed at a first location within a building, and in which administration times for a medical treatment are stored, and having a time measuring unit, and at least one signaling unit, located remote from the control unit at a second location at the building, and which communicates with the control unit via a communication connection of a communication system contained within the building, and which, upon receiving a signal from the control unit via the communication system, emits a humanly perceptible signal to remind a person within the building that it is time for a medical treatment to be administered.

As used herein, a "medical treatment" means undertaking one or more medical or health-related activities, and is not merely limited to ingesting pills or the like. Moreover, as used herein the term "at the building" includes locations outside of a building, in close vicinity to the building.

With this inventive system having the advantageous separation of the control unit that controls the timing of the administration of medications and, correspondingly, the signaling and the external signal device, the possibility is especially advantageously established of providing the patient with the corresponding signal at an arbitrary location, namely anywhere that an external signal device is provided. A number of external signal devices can be provided for this purpose, at various locations at a building. In a dwelling, for example, a signal device can be provided in each room, so that the patient can be reached everywhere. It has proven especially advantageous when, inventively, the communication connection is realized mainly by lines laid and/or to be laid at the building side or radio-supported. An EIB bus (European installation bus) can be employed as communication system of the building side. Such a communication system, which is usually already present in the building and serves the purpose of signal management for controlling various actuators such as, for example, illuminating means and the like, usually runs through all parts of the building and may also partly pass through the outer region, so that the signal devices can be especially advantageously coupled everywhere. In view of the system costs, as well, the use of the communication system that already exists proves advantageous, particularly in the form of the EIB bus, since no additional communication lines need be laid. As an alternative to the employment of hardwired communication possibilities, a wireless communication connection can be additionally provided in accordance with the invention, so that the aforementioned communication system is not limited to the immediate area of the building but also allows the arrangement and inclusion of signal devices located outside.

Optical, acoustic and/or mechanical signal devices can be inventively provided as the aforementioned signaling devices. A bell provided in the building or one or more lighting means provided at the building can thereby be expediently employed as acoustic and optical signal devices. These devices are usually already integrated in the house communication system, for example the EIB bus system, so that they can be particularly advantageously addressed accordingly with the control unit. Elements that are already present in the building are thus employed as signal devices as well, this likewise having a beneficial influence, particularly in terms of the system costs. The bell, for example, can thereby be correspondingly driven at the given point in time, so that it rings once or repeatedly or, on the other hand, in a specific sequence; the lighting means can, for example, flash briefly or the like. Additionally or alternatively, a radio receiver and/or one or more display devices reproducing the signal in the form of a visual display, particularly in the form of a television set, can also be employed. In this case, for example, a corresponding signal or a corresponding message is transmitted from the control unit to the radio receiver—preferably when the television set is operating already. Given employment of a display, particularly in the form of a television set that is usually present in a dwelling, the signal can be correspondingly mixed in the television picture, whereby, of course, the control unit is correspondingly fashioned for this purpose in order to supply the data and corresponding data formats required for this purpose.

A device that generates mechanical, acoustic or optical signals and communicates with the control and/or processing unit via the wireless communication connection and that is to be worn by the affected person can be inventively employed as additional (redundant) mechanical, acoustic and/or optical signal device. Such devices, for example in the form of silent alarm devices that are to be worn at the wrist or the like and generate vibrations are known. Given use of such a device, the patient is informed of the time for taking the medication on the basis of corresponding vibrations that can be felt, so that he can act correspondingly when the signal is given. Of course, this portable signal device can also be fashioned as an acoustic alarm. An optical alarm, for example a small display means, can also be employed, for example a SCALL device (pager). Of course, a device in the form of a portable telephone can also be utilized. Given employment of a plurality of signal devices, the signal can thereby be inventively generated at one or more, potentially all signal devices, whereby the use of the signal devices that have been mentioned is expediently based on their operating readiness, i.e., given employment of a radio receiver or of a television set, this is only addressed when the respective device is also correspondingly operating.

In order to prevent the signal from being given when the respective point in time stored in the control unit is reached despite the medication already having been taken, in an embodiment of the invention that the control unit causes the time or times for the correct administration of the medications to be displayed to the user, with a triggering of the signal ensuing dependent on the display. This allows the user to inform the control unit that the administration of the medication has already ensued, so that the signal triggering can be suppressed. For this purpose, an actuatable element can be placed in communication with the control unit via the communication system, particularly via the building lines and preferably the EIB bus. Switch elements such as, for example, a light switch existing in the building or an operating element of the display, particularly in the form of a remote control and the like can be employed as an actuation element. Of course, it is also possible to also provide separate input means for enabling an indication that the administration of the medical treatment has already ensued, for example in the form of a keyboard or the like that is directly arranged at the control unit, which, for example, can be a PC. Any suitable actuation element can be used for this purpose, the same being true for the various signal devices.

In order to relieve the patients, particularly older persons, of gathering or dosing the medications, it has proven especially advantageous when the system includes a medication dispenser that has a communicative connection with the control unit, and that makes the medications to be respectively taken available at the required point in time or just before this time. When the medication is taken in time, then this administration can be employed for forwarding the indicator signal from the medication dispenser to the control unit, i.e. the removal of the medications from the dispenser at the correct time automatically causes the control unit to be provided with the corresponding acknowledgment signal.

It has proven especially advantageous when one or more signaling times for a plurality of different medications can be stored or are stored in the control unit, whereby a specific signal can be generated for each medication, possibly using a specific signal device. According to this embodiment of the invention, a complete monitoring system is achieved that also enables a monitoring of the taking of a number of medications, so that the patient is instructed to take each and every individual medication regardless of the number of medications.

Particularly when the appertaining person is not present at the respective signaling time, it is proven advantageous when the control unit is fashioned such that the signal can be emitted at least a second time at a later point in time, this, of course, only ensuing when an acknowledgment signal was not previously provided. In order to have the certainty that the person is present at the time of the signaling or the signal repetition, it is proven especially advantageous when the system includes at least one acquisition system for determining the presence of a person within the building, this acquisition system communicating with the control unit. The control unit emits the repeated signal is generated dependent on the determination made by the acquisition system, i.e., the signal is only generated when the presence of the person has been found, so that there is then a certainty that the person will in fact perceive the signal. The acquisition system can be inventively fashioned such that it determines the actuation or movement of a door or the movement of a person, i.e. in the form of a movement sensor or the like. Additionally or alternatively, the sensor can also be an actuatable light switch that the person, for example, must actuate anyway when entering the house. Alternatively, the television set can also be employed as the acquisition system, whereby the determination that the person is present in the dwelling is established dependent on the operation of the television set. A radio device can be used for the same purpose.

Particularly when the administration of the medications was forgotten because the person was not present and the signal could not remind the patient to do this, situations can definitely occur given tardy administration that require non-routine measures, i.e., for example, consultation with a physician or a dosing adapted in conformity with the tardiness or the like. In order to be able to inform the patient of potential non-routine measures or problems, it is proven especially advantageous when the system inventively comprises at least one display device, such as in the form of the television set serving the purpose of the signal device, at which information from the control device can be emitted when the reminder signal is generated, possibly at a point in time later than the reminder signal generation. On the basis of this information, the patient can then determine how he must behave in order to counter possible consequences of the missing or delayed administration of the medication. It is expedient when, inventively, the information to be emitted can be generated dependent on medication-specific and/or patient-specific information stored at the control unit and/or dependent on the time that has passed since the original point in time for the administration of the medical treatment. The information provided to the patient is thus adapted to the actual circumstances, pertaining to the medications the patient is to take, as well as the personal constitution of the patient, since the patient's medical data such as, for example, weight, blood pressure, etc., can enter into the determination as to whether non-routine instructions are needed. The time that has elapsed since the last possible "proper" administration time may also be relevant, since this evaluation criterion can also be relevant for the actions to be prescribed from a medical point of view. The patient is thus provided with information adapted to the actual situation. The information stored in the control unit as information capable of being emitted can inventively be medication-specific information, particularly about the dosing and in the form of the administration of the medication. Alternatively or additionally, the control unit can also be fashioned for automatically setting up a communication connection, particularly a telecommunication connection to an external location for providing assistance in case a signal is generated and the presence of a person has been found, whereby, of course, a corresponding communication connection of the control unit to a corresponding communication network leading to the outside can also be provided. In a further embodiment of the invention, the control unit is fashioned such that external access to the information stored therein is possible. Such "external access" means both reading as well as writing access. It is thus possible to access the control unit which is present at the patient's dwelling from an external location, for example from a data administration center to review the information stored therein in view of being correct and up to date as well as to record new information, if necessary, for example, when the patient must take one or more new medications or, for example, a blood pressure measurement or the like is to be undertaken at other points in time.

DESCRIPTION OF THE PREFERRED EMBODIMENT

Figure 1:
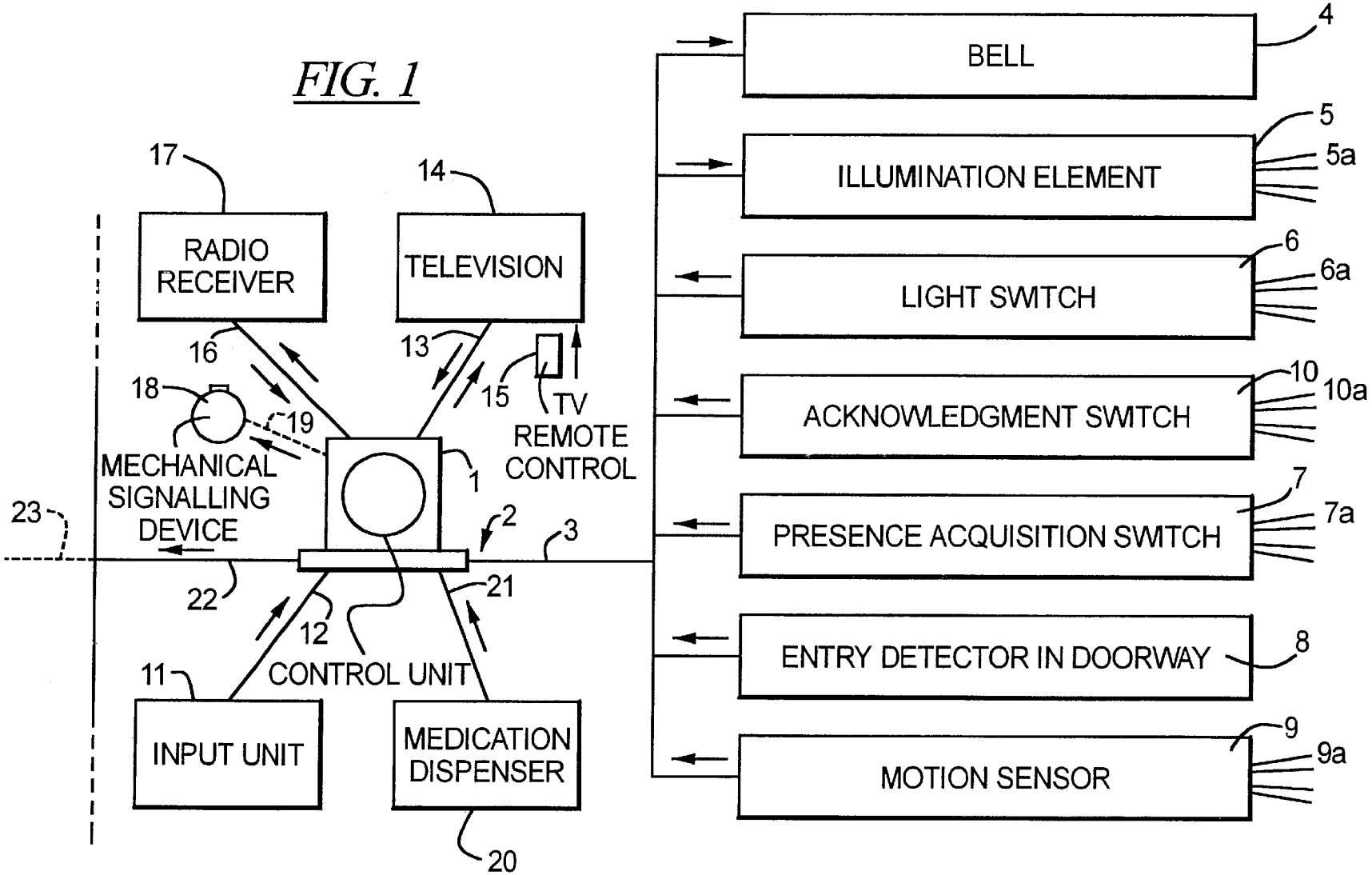
FIG. 1 is a schematic block diagram of a first embodiment of a system for generating a humanly perceptible signal as a reminder for a medical treatment, in accordance with the principles of the present invention.

FIG. 1 shows an inventive system, whose central element is the control unit 1, here in the form of a PC. The control unit 1 is connected to a number of function and signal devices via a first communication connection 2 in the form of a communication line 3 laid in the building, preferably an EIB bus. The respective direction of the signal communication is shown with corresponding arrows. First, a bell 4 is connected to the bus-like communication line 3, this bell 4 being capable of producing a signal that indicates the time a specific medication is to be taken. The control of the operation of the bell 4 ensues via the control unit 1 that including a corresponding time-measuring device in which the respective signaling times are implemented. At the corresponding point in time, the control unit 1 forwards a command to the bell 4, so that this is correspondingly actuated and indicates to the patient that the medication is to be taken. An illumination element 5 is also connected to the communication line 3, this likewise serving as signal device, whereby, of course, and as indicated by the outgoing strokes 5*a,* a number of illumination devices can be provided, for example in every room of the building. This illumination element also serves the purpose of signaling; for example, it can be activated in correspondingly flashing fashion, also under the control of the control unit 1 here. A light switch 6 (or a number of light switches 6*a*) are also coupled to the bus communication line 3. These light switches 6 and 6*a* serve as actuation devices with which a determination can be made as to whether the person to whom a signal is to be given is present in the building at all, for example the house or the dwelling. The respective light switches 6, 6*a* communicate via the communication line 3 with the control unit 1 that, given actuation of a light switch 6 or 6*a*, is provided with a corresponding signal indicating the presence of the patient. In addition to the light switch or switches 6 and 6*a*, a further presence acquisition switch 7 (or a number of such switches 7*a*) specifically provided for acquiring the presence can be provided, the purpose thereof being the same to this but the switches 7 and 7*a* being dedicated only to this function. An acquisition sensor 8 that is arranged in the area of the house or dwelling door can be provided, which, for example, is actuated and supplies a corresponding signal indicating the presence of the person to this control unit 1 when the door knob is moved or, on the other hand, when the door is swung open. In addition, a motion sensor 9 (or a plurality of motion sensors 9*a*) can be provided, this determining the motion of either, for example, the house door or of the person entering the dwelling. Finally, an acknowledgment switch 10 (or a number of acknowledgment switches 10*a*) are connected to the control unit 1 in communicating fashion via the communication line 3. With this switch or switches 10, 10*a,* it is possible for the patient to indicate to the control unit 1 that the medication was taken in timely fashion [to the control means 1], so that the control unit 1 suppresses the reminder signal when the next signaling time is reached, since the signal is not required in this case. Additionally or alternatively to these acknowledgment switches 10, 10*a*, the administration acknowledgment can also be provided with an input unit 11 in the form of the illustrated keyboard that is connected to the control unit 1 via a communication connection 12.

Additionally (of course, alternatively as well) to the signal devices 4, 5, the control unit 1 in the illustrated exemplary embodiment is connected to a television set 14 via a communication line 13. As needed, the corresponding signal can be shown to the patient with the control unit 1—of course, only when the television is on—, for example the program that is being shown can be interrupted or, a corresponding message is mixed in the television image that draws attention of the patient to the administration of the medication. At the same time, the television set 14 can serve for acquiring the presence of the patient, namely when it is on, i.e. the control unit 1 is provided with a corresponding signal, as shown with the respective arrows. In addition, the corresponding acknowledgment signal can also be provided by the television set 14 or the remote control 15 allocated to it, this indicating that the medication has already been taken.

A function similar to the television set 14 is accorded to a radio receiver 17 connected to the control unit 1 via a further communication line 16, the corresponding signal being likewise capable of being provided therewith, for example in the form of a humming or the like and the operation thereof likewise signaling the presence of the person.

In addition, the system of the invention includes a mechanical signaling device 18 in the form of a vibrating alarm to be worn, for example, at the wrist of the patient, this communicating with the control unit 1 via a wireless communication connection 19. As a reminder indicator, the signal device 18 is caused to vibrate, the patient sensing this and thus being informed that the patient should take the medication or medications. Finally, the system also includes a medication dispenser 20 that is connected to the control unit 1 via a communication line 21 and with which the acknowledgment signal can likewise be forwarded to the control unit 1, namely when the patient takes the medications offered the patient some time preceding the respective time of administration. Finally, the control unit 1 is also connected to an external telecommunication network 23 via the communication line 22, whereby the control unit 1 is fashioned such that, as needed, a communication connection to an external location offering assistance or the like can be automatically set up via the communication line 22. Thus, for example, a connection could be set up (automatically) to a central consultation location (medical advisor) who could then provide instructions on what to do. The control unit 1 is fashioned in the framework of the inventive system such that the respective signal can be forwarded to one or more, potentially all of the possible signal devices. In addition, the control unit 1 can repeat the signal if necessary, for example when one of the devices sensing the presence of the respective person provides the corresponding acquisition signal.

Figure 2:
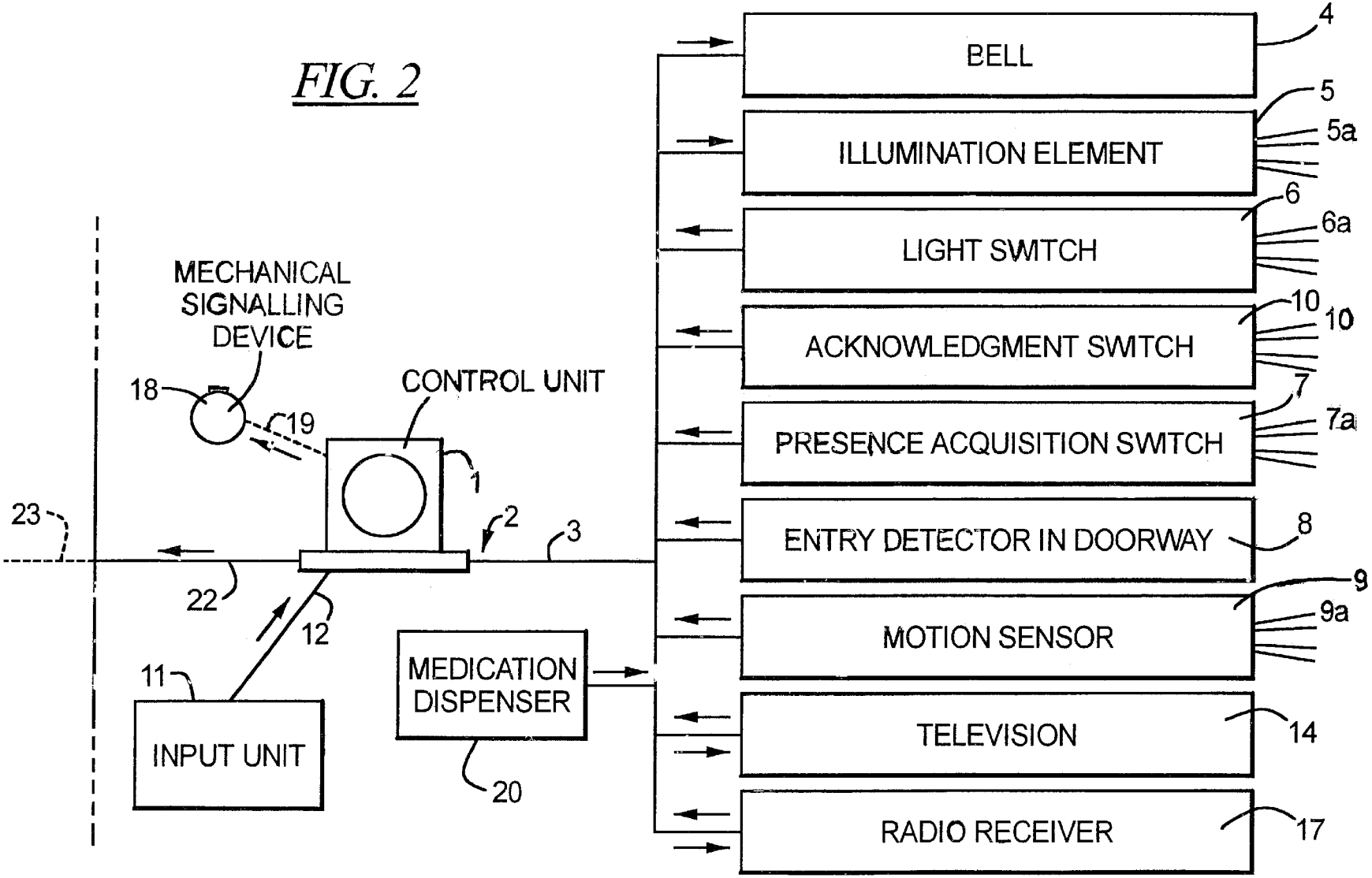
FIG. 2 is a schematic block diagram of a second embodiment of the inventive system.

FIG. 2 shows a further embodiment of the inventive system. In this system, which corresponds with the system illustrated in FIG. 1 in terms of its function components, the television set 14 and the radio receiver 17 as well as the medication dispenser 20 are connected to the communication line 3 in addition to the previous system components provided at the bus side, i.e. no separate communication lines need be provided for these.

Although modifications and changes may be suggested by those skilled in the art, it is the intention of the inventors to embody within the patent warranted hereon all changes and modifications as reasonably and properly come within the scope of their contribution to the art.

What is claimed is:

1. A system for generating a humanly perceptible signal as a reminder for administering a medical treatment, comprising:

a control unit in which at least one time is stored at which a patient is to administer a medical treatment, said control unit including a time-measuring unit which determines when said stored time occurs, said control unit being disposed at a first location within a building;

a communication system integrated in said building and having a communication connection to said control unit; and at least one signal device stationarily mounted at said building at a second location remote from said first location and having a communication connection to said communication system, said at least one signal device receiving a signal from said control unit at said stored time and emitting a humanly perceptible signal at said building as a reminder to administer medication.

2. A system as claimed in claim 1 wherein said communication system comprises hardwired lines running through said building.

3. A system as claimed in claim 1 wherein said communication system comprises a radio communication system.

4. A system as claimed in claim 1 wherein said communication system comprises an EIB bus.

5. A system as claimed in claim 1 comprising a plurality of signal devices, and wherein said communication system comprises hardwired lines connected between said control unit and a portion of said plurality of signal devices, and a wireless communication connection between said control unit and at least one signal device in said plurality of signal devices.

6. A system as claimed in claim 1 wherein said at least one signal device is a signal device selected from the group consisting of optical signal devices, acoustic signal devices and mechanical signal devices.

7. A system as claimed in claim 1 wherein said signal device is selected from the group consisting of a bell integrated in said building, an illumination element integrated in said building, a radio receiver, and a visual display device.

8. A system as claimed in claim 1 wherein said at least one signal device comprises a television set.

9. A system as claimed in claim 1 wherein said signaling device comprises a body worn device, and wherein said communication system comprises a wireless communication system, said bodyworn device including an indicatorwhich generates said reminder signal in a form selected from the group consisting of mechanical signals, acoustic signals and optical signals.

10. A system as claimed in claim 1 further comprising at least one patient-actuated unit having a communication connection via said communication system to said control unit which, when actuated by a patient, emits a signal to said control unit which suppresses generation of said reminder signal.

11. A system as claimed in claim 10 wherein said communication system comprises an EIB bus.

12. A system as claimed in claim 11 wherein said patient actuated element comprises a light switch integrated in said building.

13. A system as claimed in claim 11 wherein said at least one signal device comprises a visual display unit having a remote control associated therewith, and wherein said remote control comprises said patient actuated unit.

14. A system as claimed in claim 11 further comprising a medication dispenser having a communication connection to said communication system which dispenses medication at a time substantially coinciding with said stored time upon receipt of a signal from said control unit, and wherein said medication dispenser comprises said patient actuated unit and supplies a signal to said control unit suppressing said reminder signal when said medication is removed from said medication dispenser.

15. A system as claimed in claim 1 comprising a plurality of signal devices respectively stationarily mounted at said building at respectively different second locations remote from said first location, each of said signal devices, upon receiving a signal from said control unit, emitting said humanly perceptible signal.

16. A system as claimed in claim 1 wherein said control unit has a memory in which a plurality of different times for respectively administering a plurality of medical treatments are stored, and wherein said control unit causes said at least one signal device to emit said humanly perceptible signal in respective forms uniquely associated with said times.

17. A system as claimed in claim 16 comprising a plurality of signal devices of respectively different types, said plurality of signal devices being respectively specifically designed to emit humanly perceptible signals in said respectively different forms.

18. A system as claimed in claim 1 wherein said control unit causes said signal from said control unit to be received at said at least one signal device at least two times, separated by a time interval.

19. A system as claimed in claim 18 further comprising an acquisition arrangement for identifying a presence of a person within said building and for supplying a signal indicating said presence to said control unit, and wherein said control unit, after first supplying said signal to said signal device, supply said signal to second device a second time upon receiving said signal from said acquisition arrangement.

20. A system as claimed in claim 19 wherein said acquisition arrangement comprises an arrangement selected from the group consisting of an arrangement for identifying movement of a door in said building, an arrangement for identifying movement of a person in said building, an arrangement for identifying actuation of a light switch in said building, an arrangement for identifying actuation of an actuatable switch in said building, an arrangement for identifying when a radio receiver in said building is operated, and an arrangement for identifying when a television set in said building is operated.

21. A system as claimed in claim 1 wherein said signal device comprises a display at which said humanly perceptible signal is at least visually displayed.

22. A system as claimed in claim 21 wherein said display comprises a television set.

23. A system as claimed in claim 21 wherein said display, dependent on said signal from said control unit, displays information selected from the group consisting of medication-specific information, patient-specific information, and an elapsed time relevant to administration of said medical treatment.

24. A system as claimed in claim 23 wherein said control unit contains a memory in which at least said medication-specific information is stored.

25. A system as claimed in claim 1 wherein said system further comprises an acquisition arrangement for identifying a presence of a person in said building, and wherein said control unit comprises actuatable means for communicating with a location external from said building, upon actuation of said control unit, and if said acquisition arrangement has identified a presence of a person in said building.

26. A system as claimed in claim 1 wherein said control unit comprises an interface allowing external access to at least said time stored in said control unit.

* * * * *